United States Patent [19]

Binkley et al.

[11] 4,099,541

[45] Jul. 11, 1978

[54] POWER TRANSMISSION

[75] Inventors: Carl R. Binkley, Marshall, Mich.; John B. Keir, Marietta, Ga.; John H. Semchena, Royal Oak, Mich.

[73] Assignee: Sperry Rand Corporation, Troy, Mich.

[21] Appl. No.: 741,202

[22] Filed: Nov. 12, 1976

[51] Int. Cl.[2] ..... F15B 13/08; F15B 13/04

[52] U.S. Cl. ..... 137/596.13; 137/596.2

[58] Field of Search ..... 137/596.12, 596.13; 91/412

[56] References Cited

U.S. PATENT DOCUMENTS

| | | | |
|---|---|---|---|
| 3,160,167 | 12/1964 | Martin | 137/596.12 |
| 3,815,477 | 6/1974 | Ailshie et al. | 137/596.12 |
| 3,827,543 | 8/1974 | Malott et al. | 37/596.12 |
| 3,841,096 | 10/1974 | Koppen et al. | 60/462 |

*Primary Examiner*—Martin P. Schwadron
*Assistant Examiner*—A. Michael Chambers

[57] ABSTRACT

A directional valve assembly for use in hydraulic power systems such as are used on fork lift trucks has a plurality of sliding spool directional valves and a balanced relief valve mounted in the body formed of a plurality of sections bolted and gasketed together. The main lift section has a load-holding check valve of special design together with means on the spool for opening the check valve to lower the load. Means are provided in the assembly for preventing interflow from one valve spool to another when two or more spools are simultaneously shifted. This includes a system of restrictors, check valves and passages causing the main relief valve to act as a pressure compensator responsive to the pressure requirement of the smallest load.

5 Claims, 5 Drawing Figures

POWER TRANSMISSION

Hydraulic power transmission systems such as are widely used on mobile material handling equipment use banks of spool type directional valves for controlling the operation of various fluid motors from a common hydraulic pressure supply such as a fixed displacement pump. In applications such as those on the common fork lift truck, the aerial work platform, the elevating fire ladder and the simple implement lift on agricultural tractors, the principal duty of the hydraulic system is to power the lifting motor or motors. The power requirements of the other auxiliary motors are usually considerably less, but nevertheless these auxiliaries are supplied along with the main lift from a single pump.

It has become common to provide load holding check valves in such systems which eliminate or minimize leakage from a heavily loaded motor and thus relieve the standards or precision machining otherwise required in valves of the sliding spool type. However, the addition of load-holding check valves introduces further complexities adding to the cost of manufacture and increasing the possibility of malfunction.

It is also a problem with multiple unit directional valves supplied in parallel from a common source that whenever two or more valves are simultaneously operated, only the lightest loaded motor will operate and will receive fluid not only from the pump but from the reverse operation of the heavier loaded motor or motors resulting in overspeeding of the first motor and the lowering or reversing of the other motor or motors.

The present invention aims to provide an improved directional valve assembly for hydraulic power systems in which loading holding check valves may be incorporated with improved reliability and with a lower cost of manufacture.

The invention further aims to provide an improved load-holding check valve which may be controlled to open by means of a pilot system operated from the main valve spool.

It is also an object of the invention to provide in a multiple unit directional valve assembly a system for avoiding transfer of fluid from one valve spool to another when two or more valve spools are operated simultaneously.

These objectives are achieved in the present invention by the provision of a single acting directional valve assembly for hydraulic power systems comprising a body having an inlet port, an outlet port, and a motor port, a sliding spool in the body arranged to selectively connect the motor port either to the inlet port in load raising position or to the outlet port in load lowering position or to neither in load holding position, a load-holding check valve between the spool and the motor port and having a first valve lifting area exposed to the spool, a second valve lifting area exposed to the motor port and a valve seating area greater than either valve lifting area, a restricted orifice connecting the valve seating area to the motor port, and means on the spool for connecting the valve seating area to the outlet port when the spool is shifted to the load lowering position.

The invention also comprises a multiple unit directional valve assembly for hydraulic power systems comprising a body having an inlet port, an outlet port, and a plurality of motor ports, a plurality of sliding valve spools in the body having parallel connections to the inlet port for supplying their respective motor ports, and means for preventing fluid transfer from one spool to another when two or more spools are shifted to supply their respective motor ports, said means comprising a balanced relief valve in the body to divert flow from the inlet to the outlet directly and having a control chamber fed from the inlet port through a restriction, a restrictor between one or more of the spools and the inlet port, passage means extending to a point downstream of such restrictor from the control chamber of the relief valve, and a check valve in that passage means opening to flow out of the control chamber whereby whenever two or more spools are in motor-supply position, the relief valve will be controlled to maintain a supply pressure only sufficient to overcome the smallest load pressure in any of the motor ports which are at the time connected to the inlet port.

IN THE DRAWINGS

Figure 1:
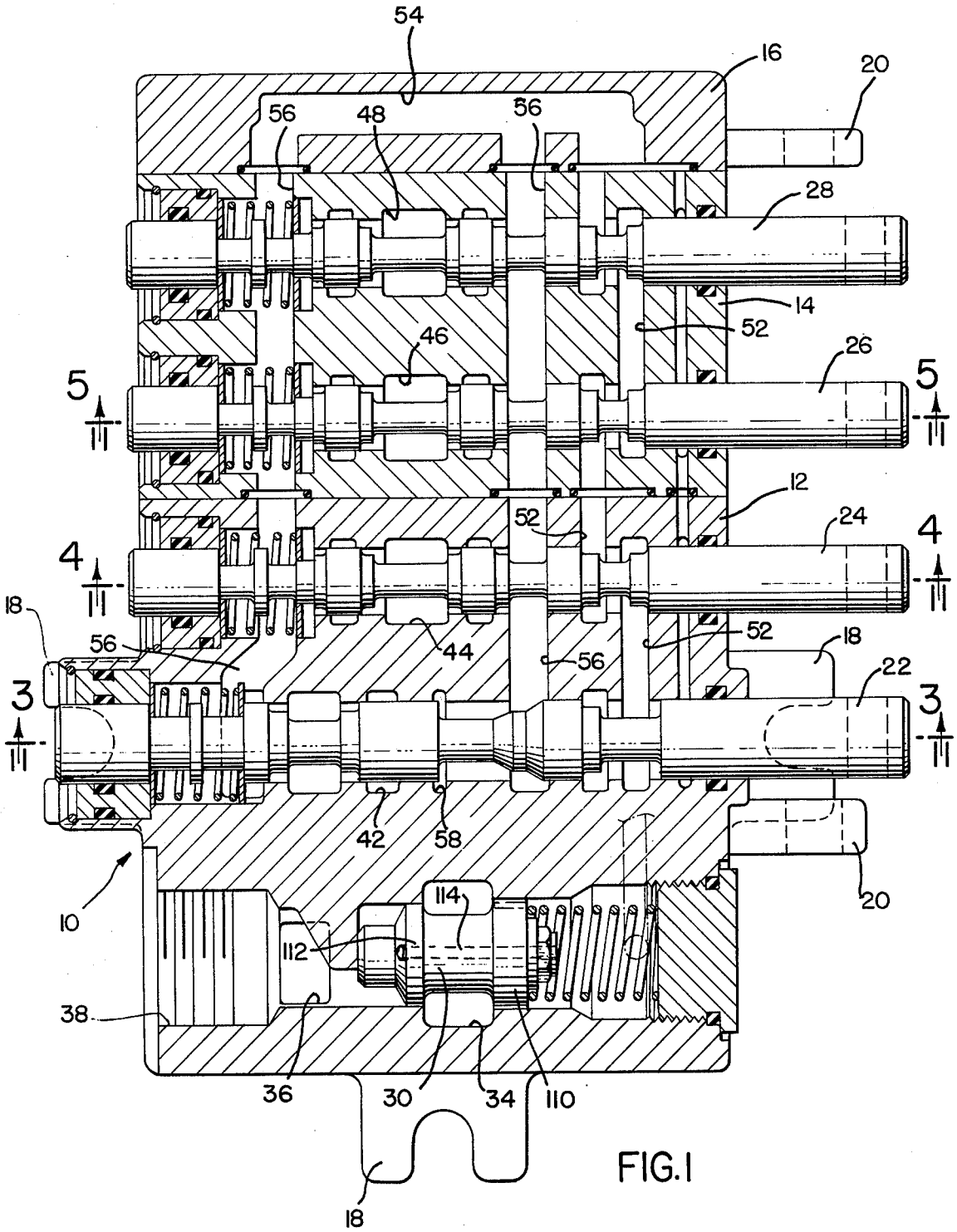
FIG. 1 is a cross sectional view of a directional valve assembly incorporating a preferred form of the present invention.
Figure 2:
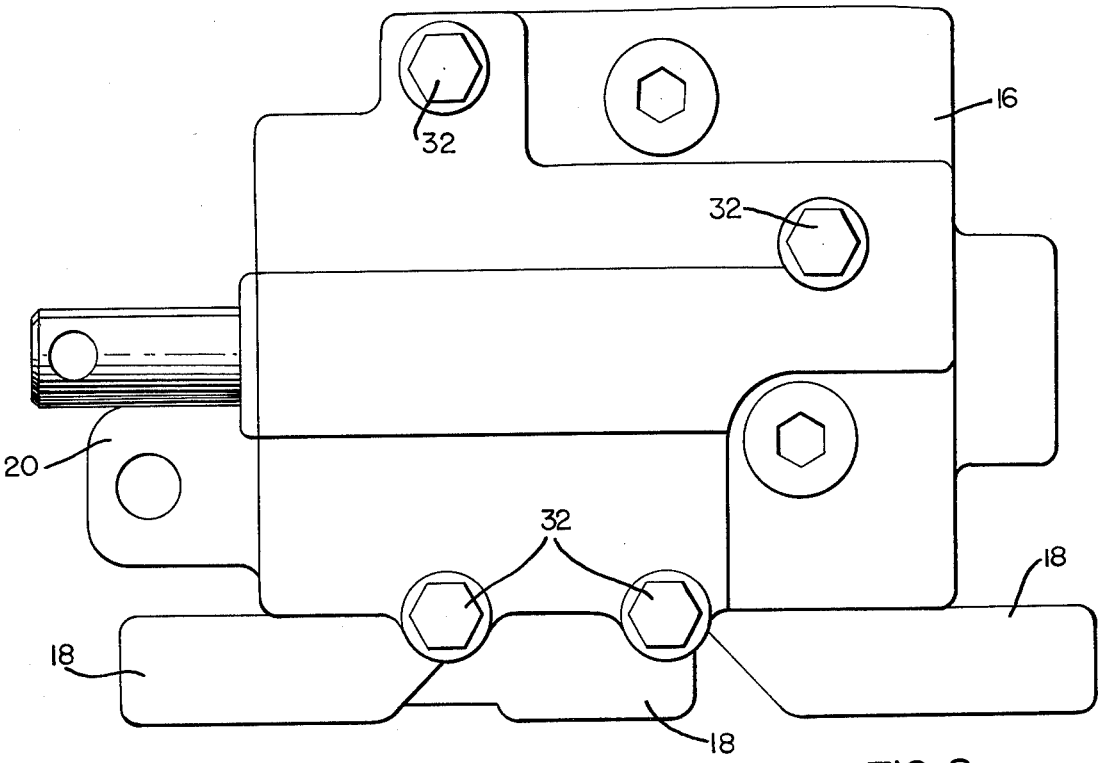
FIG. 2 is an end view of the valve assembly shown in FIG. 1.

In the preferred embodiment of the invention which is illustrated in the drawings, a valve body 10 is comprised of a main section 12, an auxiliary section 14 and an end section 16. The body section has three mounting lugs 18 for attaching the assembly to a suitable base. Ears 20 provide supports for an axle, not shown, on which suitable operating handles for the valve spools may be mounted.

The body section 12 contains bores within which are slidably mounted spools 22 and 24 for the main lift and for the tilt or other auxiliary motor respectively. Body 14 contains spools 26 and 28 for two other auxiliary purposes. Body 12 also contains a balanced relief valve 30 for limiting the maximum pressure in the hydraulic system and for other purposes later to be described. It will be understood that body section 14 and its valve spools may be omitted and the end section 16 applied directly to the valve body 12, or a single valve body section, not shown, may be interposed in place of the double valve section 14, all depending upon the requirements of the particular machine upon which the valve is used. The various body sections are clamped together by through bolts 32 of appropriate length for the number of sections being used in a particular assembly.

Body 12 contains an inlet port 36 leading from a threaded terminal 38, and an outlet port 34 leading to the threaded terminal not illustrated. The inlet port 36 communicates by passages such as 40, FIG. 3, with spool inlet ports 42, 44, 46 and 48, FIG. 1. Inlet port 36 also communicates via a passage 50 with a zig-zag passage 52 extending through the assembly to a return passage 54, in the end plate 16. This serves in the well known manner to unload the pump when all the valve spools are in centered position and to load the pump when any one or more of the spools is shifted to an operating position. Outlet port 34 connects with two through return passages 56 serving all of the valve spools as well as with a special pilot return port 58, FIG. 3, controlled by the main spool 22.

Figure 3:
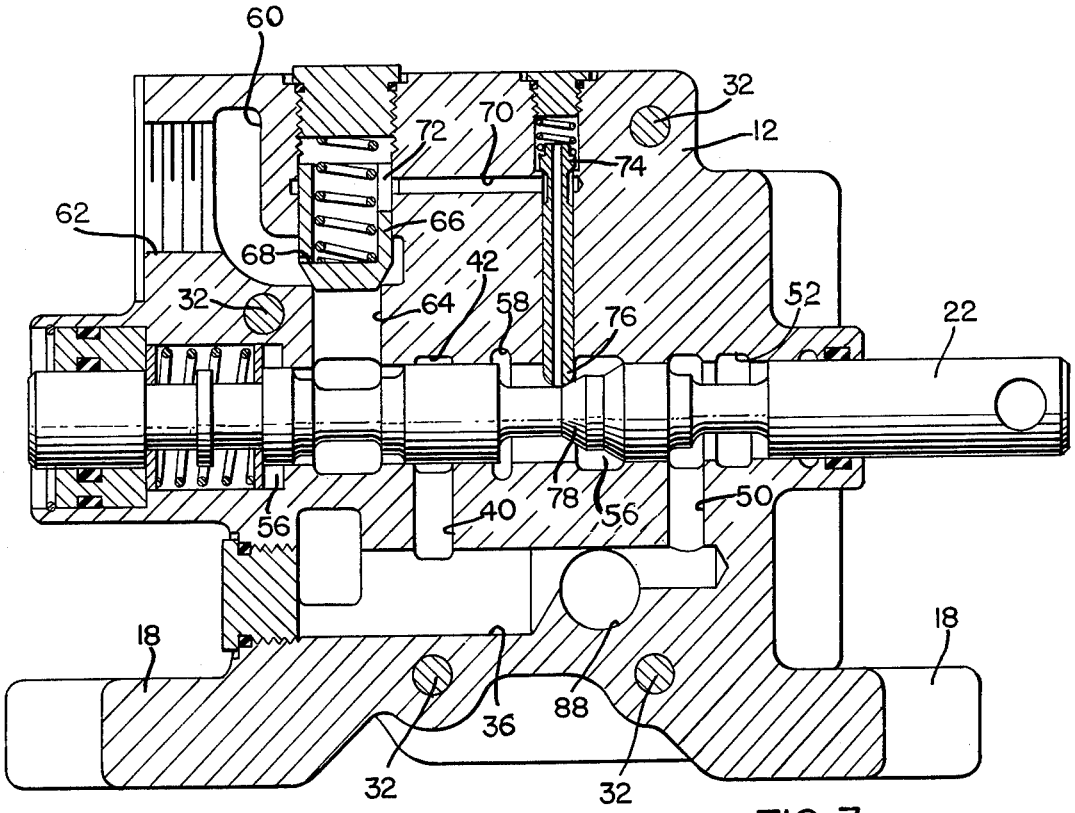
FIG. 3 is a cross sectional view on line 3—3 of FIG. 1.

Referring now to the construction of the main lift valve section controlled by spool 22, FIG. 3, this is a single acting spool having a single motor port 60 and threaded terminal 62. Spool 22 when shifted to the right can admit fluid from the spool inlet port 42 to a passage 64 and through a check valve 66 to the motor port 60. When shifted to the left, spool 22 connects passage 64 to the return passage 56 and when check valve 66 opens as will be described later, allows return flow from motor port 60 to the outlet 34. In the position of spool 22 which is illustrated, neither of these flows can occur and leakage from the lift motor is eliminated or held to a very tiny amount by the poppet type check valve 66.

This load-holding check valve 66 is constructed as a slidable hollow piston and is spring pressed downwardly with its conical lower end seatable in the top end of passage 64. This provides three fluid operating areas for shifting the valve. The area exposed to pressure in passage 64 is the first valve lifting area. That portion of the conical lower end which is exposed to pressure in the motor port 60 is the second valve lifting area, and the area exposed to pressure in the spring chamber is a valve seating area equal to the sum of both valve lifting areas and of course greater than either. A small restriction 68 connects the motor port 60 with the valve seating area and assures that the valve will remain in seated as long as pressure in motor port 60 is equal to or higher than the pressure in passage 64.

A pilot exhaust passage 70 and a slot 72 in the side wall of the valve 66 allow escape of fluid from the spring chamber at a greater rate than it can enter through restriction 68. This pilot exhaust passage is controlled by a pilot poppet valve 74 which is spring pressed downwardly and has a lower end 76 which may be engaged by a conical cam surface 78 on the spool 22 whenever the spool is shifted to the left. Such shifting allows the spring chamber of the check valve 66 to exhaust to the through return passage 56. This reduces the pressure in the spring chamber of the check valve and allows the pressure in the motor port 60 to act on the second valve lifting area to open check valve 66 and permit lowering of the load.

When the spool 22 is shifted to center again, pilot valve 74 seats and check valve 66 also seats under the action of its spring and of the pressure, if any, existing in motor port 60 and feeding to the valve seating area through restrictor 68. When spool 22 is shifted to the right, pressure will build up in passage 64 sufficient to lift the check valve 66, exhausting fluid from the valve seating area through the restrictor 68. This restrictor also acts as a dampener to both closing and opening motions of the check valve 66.

Figure 4:
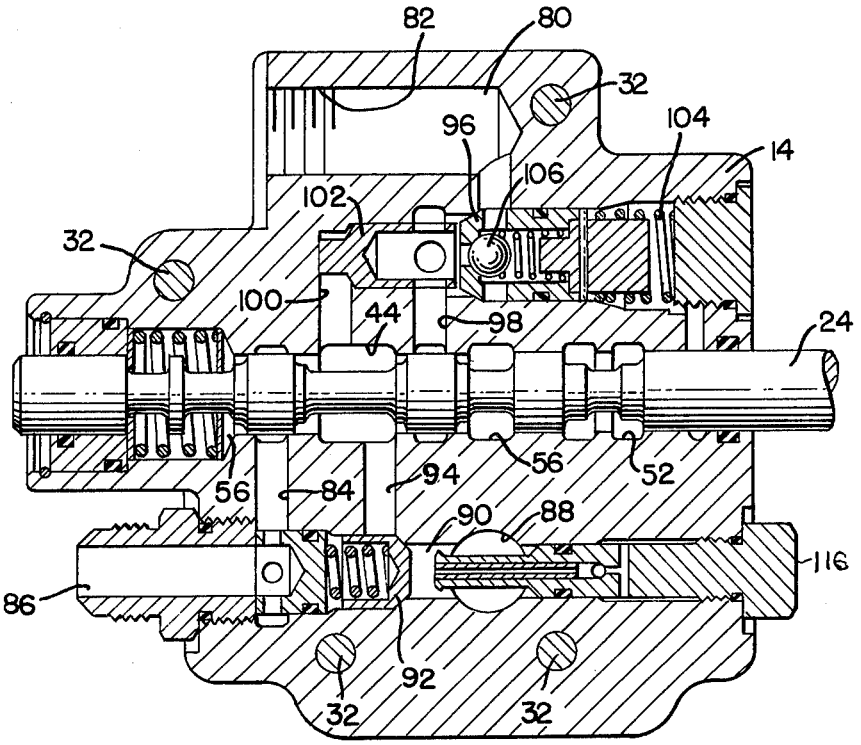
FIG. 4 is a cross sectional view on line 4—4 of FIG. 1.

Referring now to FIG. 4, the valve section which may be used for example for controlling the tilt motor of a fork truck by shifting the spool 24 is illustrated. This is a double acting valve having a first motor port 80 leading to a threaded terminal 82 and a second motor port 84 leading to a threaded terminal 86. Spool 24 controls flow in and out of the motor ports in the usual manner. The spool inlet port 44 receives fluid from the inlet port 36 through a passage 88, a restricted annular passage 90 and a load holding poppet type check valve 92 which opens to a passage 94. Thus, when spool 24 is shifted to the left, motor port 84 is supplied through check valve 92 and passage 94, but when spool 24 is shifted to the right, motor port 84 can exhaust directly to the through return passage 56.

A counterbalance check valve 96 is provided in the passage 98 leading to motor port 80 and serves, for example, to prevent over-running of the mast tilting motor of a lift truck in the foreward tilting direction by blocking out-flow from the motor port 80 when the spool 24 is centered. However, when spool 24 is shifed to the left to supply fluid to the motor port 84, pressure build-up in the spool inlet port 44 is transmitted through a passage 100 to a piston 102 and at a predetermined pressure level can overcome the force of spring 104 and open the counterbalance valve 96. An auxiliary check valve 106 is controlled by a lighter spring to more readily allow flow toward the motor port 80 from spool 24 and passage 98.

Figure 5:
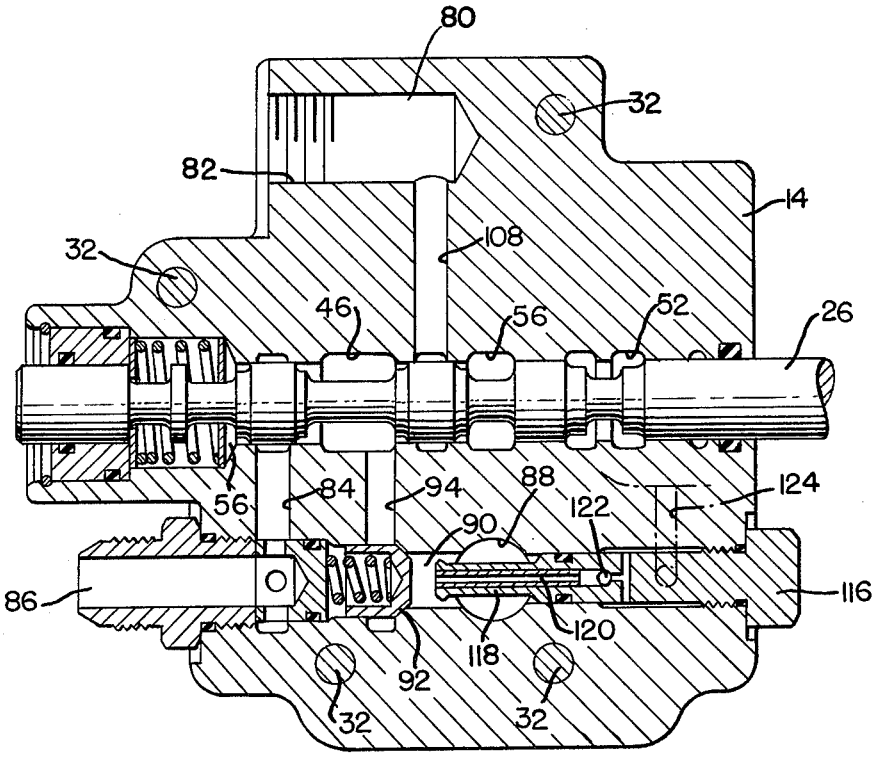
FIG. 5 is a cross sectional view on line 5—5 of FIG. 1.

Referring now to FIG. 5, the valve controlled by spool 26 is there illustrated and may be similar in all respects to the valve of FIG. 4 except that motor port 80 is fed from the spool 26 by a direct passage 108 in place of the counterbalance valve 96 and its associated parts and connections. There is illustrated here, and also in FIG. 4, the control system which prevents fluid transfer between the various spools whenever two or more are operated simultaneously.

This control system functions through the main relief valve 30 illustrated in FIG. 1. A restricted passage 114 communicates inlet pressure in port 36 to the spring chamber at the right of valve 30. The main relief valve is spring biased to the left and pressure biased to the right by inlet pressure acting on the area of land 112 and restricted pressure acting on the area of land 110. A pilot relief valve (not shown) will open when pressure exceeds a predetermined setting and allow fluid to pass out of the spring chamber faster than it can enter through passage 114, thereby causing the valve to shift to the right and bypass fluid directly from inlet port 36 to outlet port 34.

In order to prevent flow transfer when any two or more of the spools 24, 26 and 28 are open, there is provided a flow regulating cartridge generally designated 116 for each of the three auxiliary spools. These comprise a hollow rod 118 extending across the inlet passage 88 and having a double conical bead forming an annular knife-edged orifice 90. From a point downstream of the orifice 90, a central passage 120 leads to a check valve 122, the inlet side of which connects through a passage 124, illustrated in phantom lines, which connects with the spring chamber of the relief valve 30. Thus, whenever two or more of the auxiliary spools are operated simultaneously, it is only that motor which requires the least pressure to overcome its load which will allow its check valve 122 to open and exhaust fluid from the spring chamber of the relief valve 30. Under these conditions, the relief valve operates as a pressure compensating valve or hydrostat. The check valves 122 for the other spools may or may not open, but the low value of the pressure maintained in the inlet port 36 by the hydrostat action of valve 30 will not be sufficient to operate the loads controlled by the other spool or spools.

We claim:

1. In a multiple unit directional valve assembly having a body, an inlet port in said body, an outlet port in said body and a plurality of motor ports in said body, said valve having a plurality of valve bores each communicating with one of said motor ports, a plurality of inlet passages in said body, each inlet passage communicating with one of said valve bores, said inlet passages being in parallel connection to the valve inlet port, said valve having a valve spool in each valve bore shiftable to effect communication between one of said inlet passage and one of said motor ports and having a balanced relief valve in the body to divert flow from the inlet port to the outlet port directly, said relief valve having a control chamber fed from the valve inlet through a restriction, that improvement comprising:

separate restrictors in at least two of said inlet passages;

separate passage means extending from said control chamber to points downstream from said separate restrictors; and a check valve in each of said separate passage means, said check valves being so oriented as to permit flow out of said control chamber, whereby whenever two or more spools are in the motor-supply position, the relief valve will be controlled to maintain a supply pressure only sufficient to overcome the smallest load pressure in any of the motor ports which are at the time connected to the inlet port.

2. A valve assembly as defined in claim 1 having a load holding check valve in at least one of said inlet passages downstream from the restrictor in said passage.

3. A valve assemly as defined in claim 1 wherein one of said restrictors and one of said check valves are formed as a cartridge assembly replaceable in the body as a single unit.

4. A valve assembly as defined in claim 3 wherein the cartridge assembly includes a portion of said separate passage means.

5. A valve assembly as defined in claim 1 wherein said separate restrictor comprises a rod defining an annular flow passage in one of said inlet passages.

* * * * *